US009259036B2

(12) United States Patent
Burmeister et al.

(10) Patent No.: US 9,259,036 B2
(45) Date of Patent: Feb. 16, 2016

(54) PIVOT SLEEVE

(75) Inventors: Abraham Burmeister, Brooklyn, NY (US); Tyler Clemens, Brooklyn, NY (US)

(73) Assignee: Outlier Incorporated, Brooklyn, NY (US)

( * ) Notice: Subject to any disclaimer, the term of this patent is extended or adjusted under 35 U.S.C. 154(b) by 949 days.

(21) Appl. No.: 12/917,457

(22) Filed: Nov. 1, 2010

(65) Prior Publication Data

US 2012/0102618 A1 May 3, 2012

(51) Int. Cl.

| | |
|---|---|
| ***A41B 1/08*** | (2006.01) |
| ***A41D 27/10*** | (2006.01) |
| ***A41H 3/00*** | (2006.01) |

(52) U.S. Cl.

CPC . *A41B 1/08* (2013.01); *A41D 27/10* (2013.01); *A41H 3/00* (2013.01)

(58) Field of Classification Search

CPC ..... A41D 27/10

USPC ..... 2/122, 115, 69, 79, 106, 77, 467, 102, 2/108, 113, 90, 67, 121, 85, 93, 125, 87, 2/243.1, 78.1, 78.3, 82; 112/475.11, 112/475.09

See application file for complete search history.

(56) References Cited

U.S. PATENT DOCUMENTS

| | | | | | |
|---|---|---|---|---|---|
| 2,369,416 | A | * | 2/1945 | Solomon | 2/115 |
| 2,839,756 | A | * | 6/1958 | Geiss | 2/125 |
| 2,848,719 | A | * | 8/1958 | Clyne | 2/125 |
| 3,453,662 | A | | 7/1969 | Weiss | |
| 3,654,632 | A | | 4/1972 | Lacruix | |
| 3,840,900 | A | | 10/1974 | Cruz | |
| 4,249,268 | A | * | 2/1981 | Berler | 2/115 |
| 4,473,908 | A | * | 10/1984 | Knecht | 2/115 |
| 4,616,366 | A | | 10/1986 | Mueller | |
| 4,939,844 | A | * | 7/1990 | Fujimura et al. | 33/12 |

* cited by examiner

*Primary Examiner* — Khaled Annis
(74) *Attorney, Agent, or Firm* — Eric Adler

(57) ABSTRACT

A formal shirt that allows for increased athletic movement and a method for production of such a shirt. Increased movement is achieved by sewing a "pivot panel" between the front and back shirt panels. The pivot panel moves the side seam away from the major stress concentrations caused by common lumbar and brachial rotations. The pivot panel avoids binding at the shoulders, tends to reduce wrinkling, and prevents the shirttails from coming untucked.

4 Claims, 6 Drawing Sheets

PIVOT SLEEVE

CROSS REFERENCES TO RELATED APPLICATIONS

This application claims the benefit of Applicants' prior provisional application, application No. 61/256,391, filed on Oct. 30, 2009.

FIELD OF INVENTION

The invention relates to upper body garments that allow for physical activity and increased movement while retaining a professional appearance.

BACKGROUND

Traditional dress shirts tend to restrict upper body movement. For example, bending forward (anteriorly) at the waist more than a few degrees tends to displace the entire shirt in relation to the wearer's body. This displacement tends to pull the rear shirttails 101 out of the pants. Reaching forward (rotating the arms at the shoulders as shown in FIG. 1) while bending at the waist amplifies this problem. Reaching forward while bending concentrates tensile stresses laterally across the yoke 102 and axially down the sleeves 109. As a result of these stresses, the cuffs 103 are axially displaced away from the wrist and toward the shoulders. If such sleeve displacement is opposed by other forces, the shirt will begin to fail, often tearing at the seams between the sleeve and armscye 104.

Traditional dress shirts restrict this type of abdominal and brachial movement because they are made from relatively inelastic textiles. While these textiles maintain a crisp, professional appearance, they allow only small elastic deformations before failure occurs. The greatest restrictions tend to occur at the seams connecting the front and back panels of the shirt 5 (the "side seams"). In traditional dress shirt construction, the side seam runs from the center of the armpit 6, downwardly to the bottom of the shirt 107. Stitching (such as the stitching of the side seam) significantly restricts textile deformation axially along the direction of the seam. The unstitched fabric surrounding the seam permits more elastic deformation. As a result, a stitched seam concentrates and transmits tensile stress while shearing the neighboring fabric.

The stitching of the side seam resists forward and upward movement of the arms when rotated at the shoulders. This seam translates tensile stress, under the armpit, in three directions. First, stresses extend laterally across the yolk 102 and back panel 108 towards the opposite shoulder; second, stresses run down the back panel towards the rear shirttails 101; and third, stresses extend axially down the sleeve 109 towards the cuff 103. The resulting stresses tend to pull the cuff 103 away from the wrist and the shirttails 101 out of the pants. In addition, the resulting stresses cause wrinkling (semi-permanent three-dimensional fabric deformations). Wrinkling creates an unprofessional appearance and tends to reduce the lifespan of a garment.

The prior art teaches a variety of athletic shirts that allow for a full range of lumbar and brachial movement. However, such athletic shirts are inappropriate in formal business settings. Athletic shirts are often made from elastomers (fabrics with a low Young's modulus and high elastic limit). These elastic properties allow unconstrained upper body movement and greater fabric deformations before fabric or seam failure occurs. Other prior art shirt designs use traditional textiles, but add extra large shoulders to afford an increased range of motion. Either type of prior art design fails to maintain the finely tailored appearance required for formal and business attire.

Several attempts have been made to reconcile the requirements of formal appearance and athletic mobility. Many of these efforts involve adding additional material, such as darts or plackets, to the shirt's back panel or sleeves. However, this additional material adds cost and complexity to the production process. Furthermore, such additional material adds weight and bulk to a shirt. This tends to reduce comfort and may deviate from the requirements of formal or business attire.

A prior art shirt design may be custom tailored to the wearer. Custom tailoring may improve appearance and help reduce the functional problems associated with dress shirts, but it adds significant production costs.

For the foregoing reasons, there is a need for a shirt that may be worn in a formal or business setting, while also allowing the wearer to engage in physical activity such as bending and reaching forward without tearing the shirt or pulling the shirttails out of the pants.

SUMMARY

An object of the present invention is to provide an upper body garment that allows for a wide range of upper body movement, while maintaining a formal appearance. It is a further goal of the invention to maximize comfort and prolong shirt lifespan. It is a further goal of the invention to provide an economical means for creating such a garment.

These objects are accomplished through the use of a "pivot panel" 201. A pivot panel is a length of material that runs from the armpit 202, caudally (away from the head), to the side shirttails 203 (the bottom edge of the shirt near the wearer's hip). The upper edge of the pivot panel 201 is attached to the sleeve at the armpit 202, the anterior edge 204 of the pivot panel is attached to the front panel of the shirt 205, and the posterior edge 206 is attached to the rear panel of the shirt 207.

The pivot panel affords at least three advantages over traditional dress shirt construction. The pivot panel allows for a greater range of lumbar and brachial movement, avoids displacing the shirt in relation to the wearer's body during these movements, and simultaneously minimizes the formation of wrinkles during such movement. These advantages are achieved by distributing tensile stresses evenly throughout the pivot panel material rather than concentrating stresses at the seams.

A formal shirt appearance is maintained through the use of traditional shirt textiles. Traditional shirt textiles, such as textiles spun substantially from cotton fibers, are capable of maintaining the crisp appearance required for shirts in professional and formal settings. In general, traditional textiles are relatively inelastic. That is, traditional textiles have a high Young's modulus and low yield strain as compared to elastomer based textiles such as Spandex.

Although the device has been described in terms of a shirt, its use is not limited to shirts. The invention encompasses other types of garments including, without limitation, coats, suit jackets and blouses. Other uses, objects, advantages, and features of the invention will be evident from the following detailed description, from the claims, and from the drawings.

DETAILED DESCRIPTION AND PREFERRED EMBODIMENT

Figure 1:
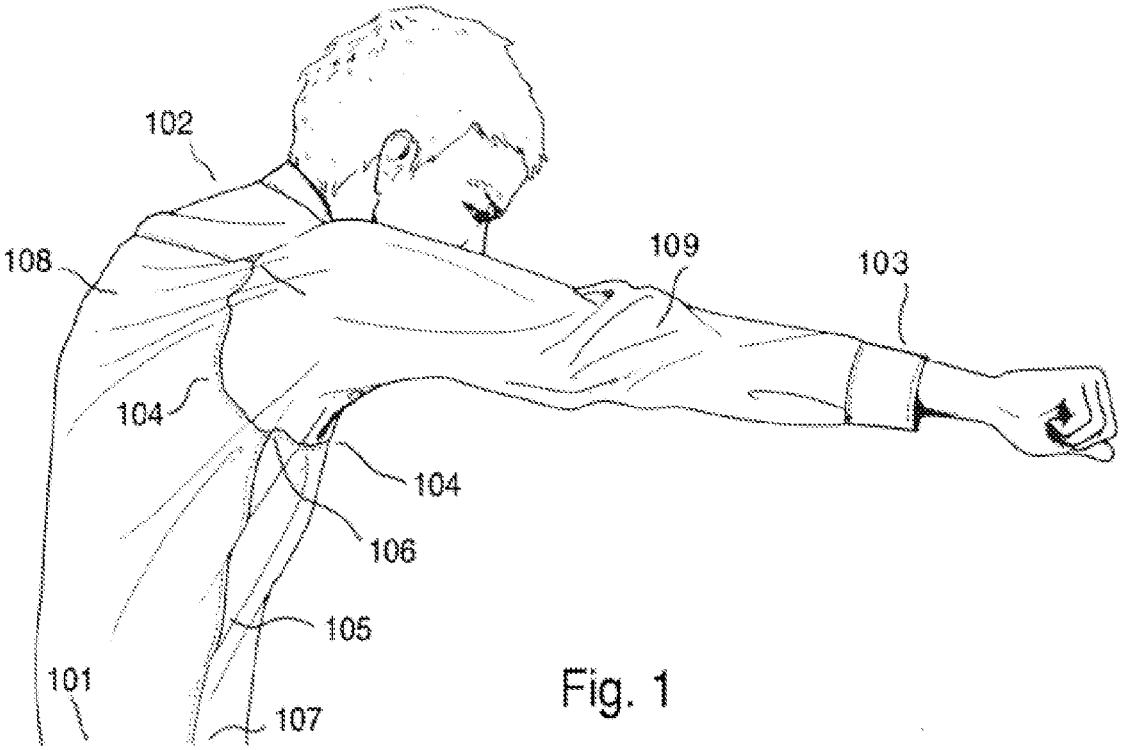
Fig. 1 Prior Art
FIG. 1 illustrates a prior art shirt as worn on a person bending forward.
Figure 2:
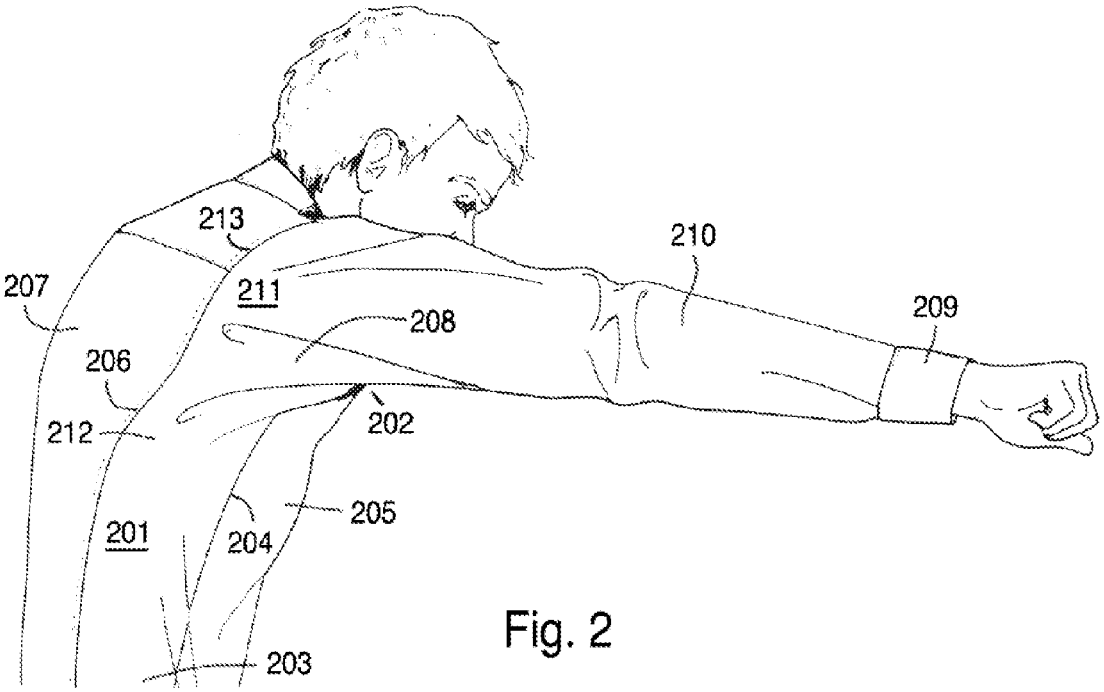
FIG. 2 illustrates a "pivot sleeve" shirt as worn on a person bending forward.

In an exemplary embodiment, the pivot panel is a "pivot sleeve" 208. A pivot sleeve is a single piece of material that forms both the pivot panel and shirt sleeve. FIG. 2 illustrates a "pivot sleeve" shirt as worn on a person bending forward. In the exemplary embodiment, the pivot panel and sleeve are formed from a single piece of material (the "pivot sleeve") 208. No stitching, seam or other attachment is required to connect the pivot panel 201 to the sleeve 210. The pivot sleeve is a single piece of material extending from the cuff 209, down the sleeve 210, changing direction at the shoulder 211, continuing down the sides of the shirt 212 and ending at the side shirttails 203. The sleeve portion is attached to the front shirt panel 205 at the armscye 213, the anterior edge 204 of the pivot panel is attached to the front panel of the shirt 205, the posterior edge of the pivot panel 206 is attached to the rear panel of the shirt 207.

A pivot sleeve provides the additional benefits of improving comfort and increasing overall shirt strength. When the wearer reaches forward, tensile stress is distributed evenly along the pivot sleeve, rather than translated laterally across the shoulders or down the back. In addition to allowing greater mobility, the pivot sleeve avoids stress concentrations at seams. Stress concentrations at the seams can jeopardize performance and ultimately result in premature seam failure. Avoiding such stress concentrations at the seams tends to prolong the life of the shirt.

In traditional dress shirt design, the side seam connects to the armscye seam under the armpit 106. Since the shirt materially is generally folded-over at each seam, this three-way junction adds significant bulk under the armpit. This additional bulk is likely to cause discomfort. This seam junction is also subject to constant shear stress caused by friction between the wearer's arm and torso. Such shear stress tends to reduce the shirt's lifespan. Pivot sleeve construction avoids a seam junction under the armpit, creating a more comfortable fit and prolonging the useful life of the shirt.

In an exemplary embodiment, the pivot panel's bias 601 runs roughly parallel the direction of stress caused by reaching forward, thereby increasing the pivot panel's elasticity in the critical direction.

In an exemplary embodiment, the sleeve is a one-piece sleeve. One-piece sleeve construction minimizes the number of sleeve seams. Minimizing seams tends to reduce stress concentrations and avoids translating the direction of tensile stresses across the back. This tends to minimize wrinkle formation and helps maintain a formal business appearance.

Figure 3:
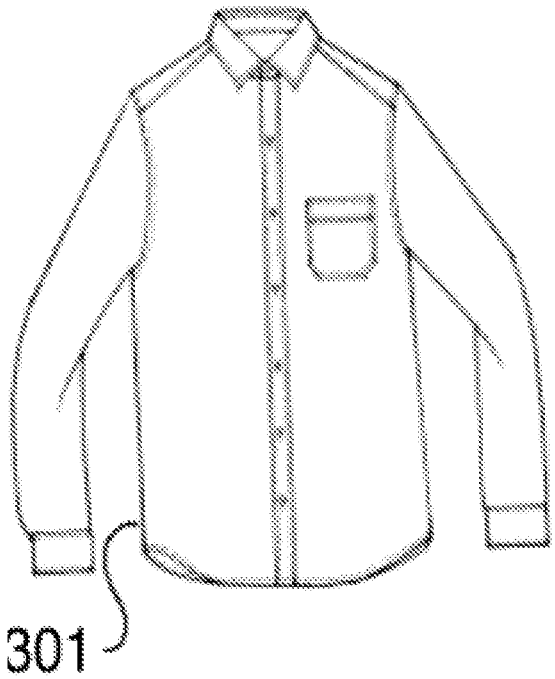
FIG. 3 illustrates a front view of a "pivot sleeve" shirt.

FIG. 3 illustrates a front view of a shirt incorporating a pivot sleeve. When viewed from the front, a shirt incorporating a pivot panel appears nearly identical to a prior art dress shirt. This ensures its acceptance in formal and business environments.

Figure 4:
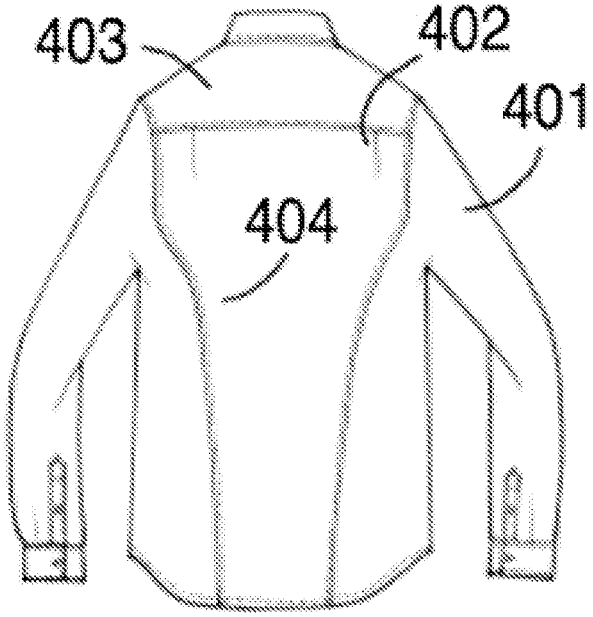
FIG. 4 illustrates a rear view of a "pivot sleeve" shirt.

FIG. 4 illustrates a rear view of a shirt incorporating pivot sleeves 401. In an exemplary embodiment, the shirt includes two darts 402 on the yoke 403. These darts increase the amount of fabric available for forward bending and reaching motions. While the wearer is standing erect with arms relaxed, the darts gather excess material and help maintain a neat and professional appearance.

In an exemplary embodiment, the anterior and posterior edges of the pivot panel are not parallel. The seam between the anterior edge of the pivot panel 204 and the front shirt panel 301 runs essentially parallel to the wearer's spine, maintaining a formal business appearance when viewed from the front. In the exemplary embodiment, the rear edge 404 of the pivot panel curves toward the wearer's spine, resulting in a bottom pivot panel edge that is wider than the diameter of the pivot panel at the armscye.

Figure 5:
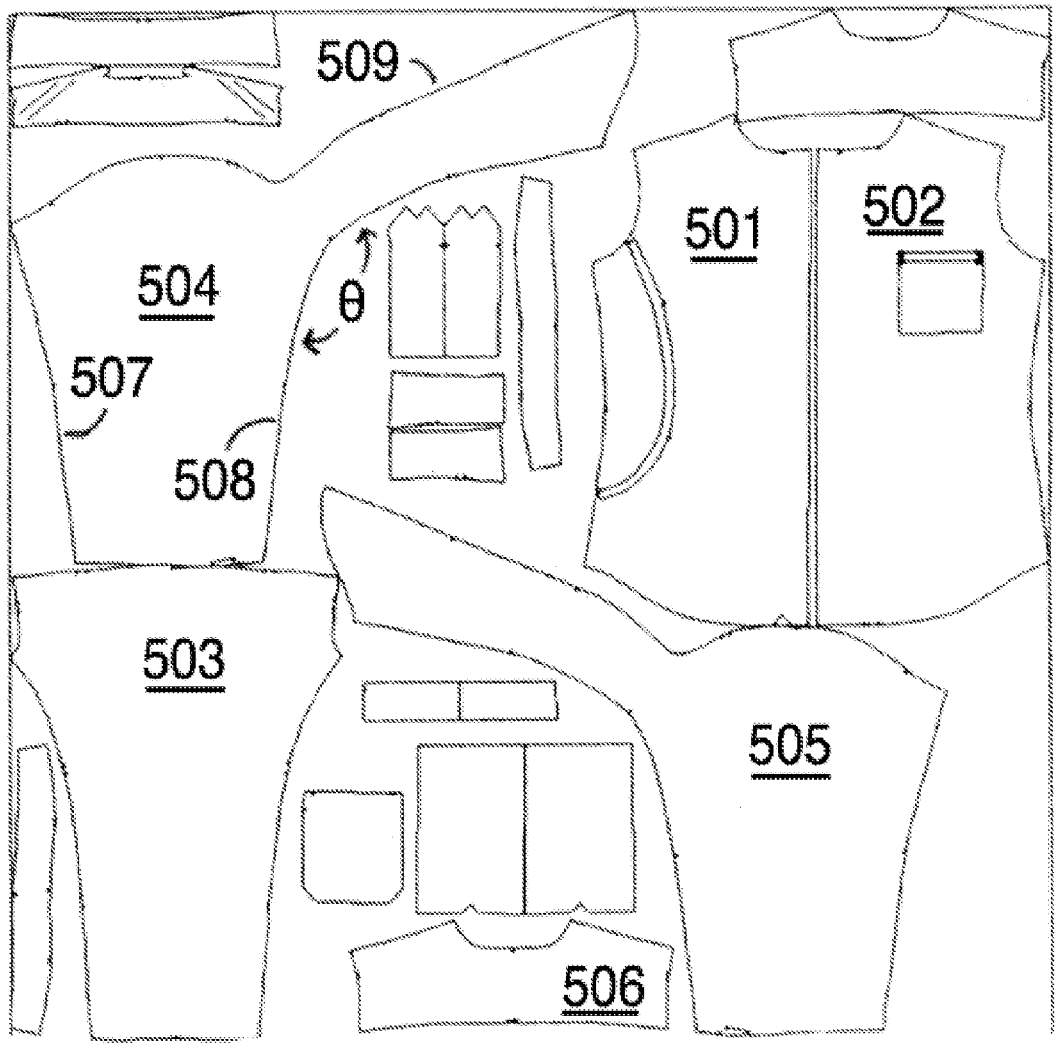
FIG. 5 illustrates a pattern laying out the parts of a "pivot sleeve" shirt.
Figure 6:
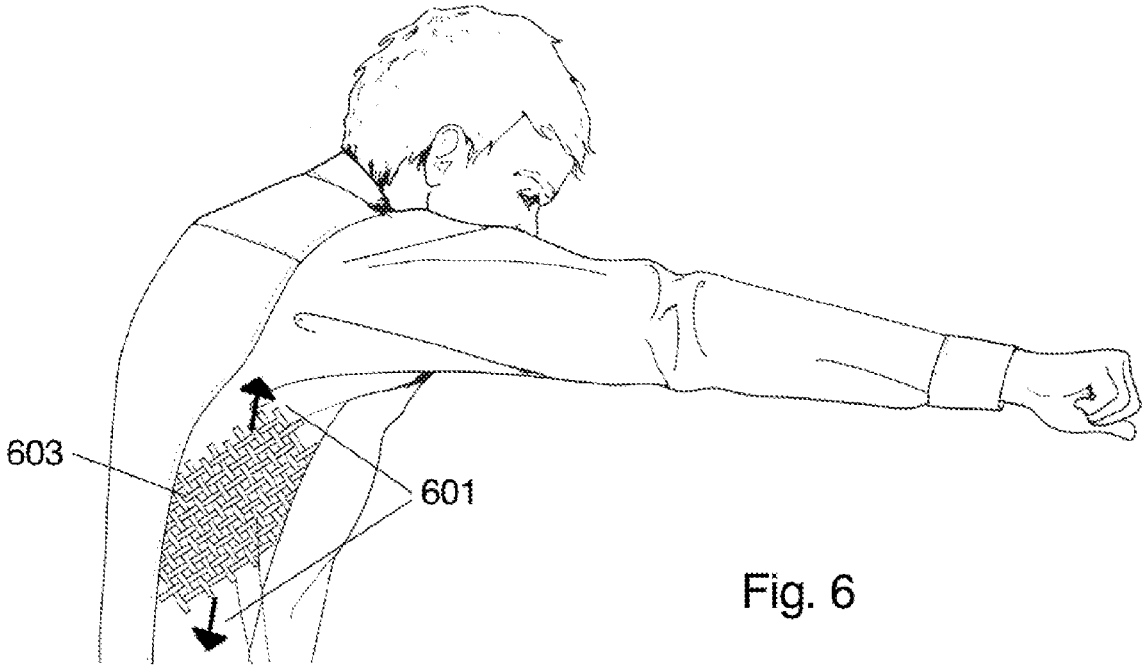
FIG. 6 illustrates a "pivot sleeve" shirt as worn on a person bending forward. The size of the textile weave 603 is exaggerated to show the direction of bias 601.

FIG. 5 illustrates a pattern laying out the parts of a shirt, including a pivot sleeve. The major components of the shirt include the right front panel 501, the left front panel 502, the back panel 503, the right pivot sleeve 504 the left pivot sleeve 505 and the yolk 506. The pattern is laid out on a piece of fabric and the fabric is cut along the edges of the pattern to form the components of the shirt. Although the exemplary embodiment demonstrates a method of efficiently cutting every shirt component from a single textile rectangle, the invention need not be cut from a single large textile.

In the exemplary embodiment, a single piece of material 504 is cut to form both a sleeve-section and a pivot panel 509. The pivot panel extends away from the sleeve at an angle θ. After it is cut, one edge 507 of the material is stitched to the opposite edge 508 to form a sleeve-section. The sleeve-section is essentially a cylinder adapted to accept a human arm.

In an exemplary embodiment, the pieces of the shirt are cut from a textile spun substantially from cotton fibers. However, the shirt may be cut from any traditional shirt textile, including synthetic textiles. Use of a traditional textile ensures the shirt's acceptance in professional and formal settings.

What is claimed is:

1. A sleeve for an upper body garment comprising a sleeve-section and a pivot panel, wherein a. an edge of the sleeve-section is attachable to a shirt's armscye, b. a posterior edge of the pivot panel is attachable to a side edge of a back shirt panel, c. and an anterior edge of the pivot panel is attachable to a side edge of a front shirt panel, and d. the sleeve is capable of being cut from the same material as the garment.

2. The sleeve of claim 1 wherein the sleeve-section and pivot panel are provided by a pivot sleeve.

3. The sleeve of claim 1 wherein a. the sleeve-section and pivot panel are a single piece of material, which extends i. from a cuff of the sleeve, ii. up the sleeve to a shoulder, iii. pivots at the shoulder, and iv. is capable of traveling at least some distance towards a lower edge of the upper body garment.

4. The sleeve of claim 1 wherein, a. a bias of the pivot panel runs substantially downwardly away from the armscye.

* * * * *